US007927136B2

(12) United States Patent
Miyashita et al.

(10) Patent No.: US 7,927,136 B2
(45) Date of Patent: Apr. 19, 2011

(54) CONNECTOR WITH SHIELDING CONNECTING PORTION AND PRESS-CRIMPING MEMBER

(75) Inventors: Takashi Miyashita, Tokyo (JP); Osamu Hashiguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 39 days.

(21) Appl. No.: 12/310,659

(22) PCT Filed: Sep. 6, 2007

(86) PCT No.: PCT/JP2007/067443

§ 371 (c)(1),
(2), (4) Date: Mar. 3, 2009

(87) PCT Pub. No.: WO2008/029896

PCT Pub. Date: Mar. 13, 2008

(65) Prior Publication Data

US 2010/0178801 A1 Jul. 15, 2010

(30) Foreign Application Priority Data

Sep. 7, 2006 (JP) ..... 2006-243387

(51) Int. Cl.
*H01R 9/05* (2006.01)

(52) U.S. Cl. ..... 439/585; 439/877

(58) Field of Classification Search ..... 439/585, 439/877, 607.41, 607.5, 607.51
See application file for complete search history.

(56) References Cited

U.S. PATENT DOCUMENTS

| | | | | |
|---|---|---|---|---|
| 5,041,021 | A * | 8/1991 | Sato | 439/585 |
| 5,145,409 | A * | 9/1992 | Sato et al. | 439/585 |
| 5,246,384 | A * | 9/1993 | Sato | 439/585 |
| 6,200,162 | B1 * | 3/2001 | Aoyama et al. | 439/578 |
| 6,210,223 | B1 * | 4/2001 | Aoyama et al. | 439/585 |
| 6,533,609 | B2 * | 3/2003 | Koide | 439/578 |
| 6,709,290 | B2 * | 3/2004 | Yoshida | 439/585 |
| 6,808,417 | B2 * | 10/2004 | Yoshida | 439/585 |
| 7,160,150 | B2 * | 1/2007 | Annequin | 439/585 |
| 7,232,341 | B2 * | 6/2007 | Shinmyo | 439/607.51 |
| 7,422,480 | B1 * | 9/2008 | Musick et al. | 439/585 |
| 7,635,282 | B2 * | 12/2009 | Sakamoto | 439/578 |
| 2003/0049966 | A1 * | 3/2003 | Yoshioka | 439/610 |

FOREIGN PATENT DOCUMENTS

| | | |
|---|---|---|
| JP | 148780/1988 | 5/1990 |
| JP | 4-92378 | 3/1992 |
| JP | 2003-297493 | 10/2003 |
| JP | 2003-317882 | 11/2003 |
| JP | 2004-186057 | 7/2004 |

OTHER PUBLICATIONS

International Search Report.

* cited by examiner

*Primary Examiner* — Hae Moon Hyeon
(74) *Attorney, Agent, or Firm* — Collard & Roe, P.C.

(57) ABSTRACT

A connector to be connected to a cable having a core wire and a shielding wire includes a contact having a terminal portion to be connected to the core wire, an outer conductor having a shield connecting portion to be connected to the shielding wire, and a housing holding the contact and the outer conductor. The shield connecting portion is separated from the housing in an axial direction. The outer conductor has an opening portion formed between the shield connecting portion and the housing and opening in a radial direction perpendicular to the axial direction. The terminal portion is exposed inside the outer conductor and faced to the opening portion in the radial direction.

10 Claims, 7 Drawing Sheets

CONNECTOR WITH SHIELDING CONNECTING PORTION AND PRESS-CRIMPING MEMBER

CROSS REFERENCE TO RELATED APPLICATIONS

This application is the National Stage of PCT/JP2007/067443 filed on Sep. 6, 2007, which claims priority under 35 U.S.C. §119 of Japanese Application No. 2006-243387 filed on Sep. 7, 2006. The international application under PCT article 21 (2) was not published in English.

TECHNICAL FIELD

This invention relates to a connector to be connected to a cable and, in detail, to connection and shielding between the cable and a contact of the connector.

BACKGROUND ART

For example, Japanese Unexamined Utility Model Application Publication (JP-U) No. H2-69484 (hereinbelow, will be called a "related art 1") discloses a connection structure in which a coaxial cord is connected to a coaxial connector. The connection structure comprises a center conductor connecting member for receiving a forward end of a center conductor of a coaxial cord which is inserted into a circular tube shape by a predetermined length and externally press-crimping and connecting the center conductor, and a cylindrical outer conductor connecting member for receiving an end portion of an outer conductor of the coaxial cord which is fitted over it by a predetermined length, further receiving a caulking tube as a press-crimping member which is superimposed on the outer conductor, and externally caulking the caulking tube to integrally press-crimping and connecting the outer conductor. The outer conductor connecting member is provided with two openings opposite to each other and formed on a cylindrical surface thereof at a position where the center conductor is press-crimped. Further, the caulking tube is used which is externally contacted with the outer conductor connecting member and which has a tube length extended so as to at least close the openings.

Patent Document 1: Japanese Unexamined Utility Model Application Publication (JP-U) No. H2-69484

DISCLOSURE OF THE INVENTION

Problem to be Solved by the Invention

In the related art 1, an entire structure, including the outer conductor connecting member and the coaxial cord, is formed in a cylindrical shape. Therefore, press-crimping connection between the center conductor and the center conductor connecting member, and press-crimping connection between the outer conductor and the outer conductor connecting member lack reliability due to movement and rotation of the caulking tube as the press-crimping member.

It is therefore an exemplary object of the present invention to provide a connector which is improved in reliability of connection by preventing a press-crimping member from falling off or rotating upon connection with a cable.

Means to Solve the Problem

According to an exemplary aspect of the present invention, there is provided a connector to be connected to a cable having a core wire and a shielding wire, the connector comprising a contact which has a terminal portion to be connected to the core wire, an outer conductor which has a shield connecting portion to be connected to the shielding wire, and a housing which holds the contact and the outer conductor, wherein the shield connecting portion is separated from the housing in an axial direction, the outer conductor has at least one opening portion which is formed between the shield connecting portion and the housing and opened in a radial direction perpendicular to the axial direction, and the terminal portion is exposed inside the outer conductor and faced to the at least one opening portion in the radial direction.

Effect of the Invention

The connector may comprise a press-crimping member for clamping the shielding wire in cooperation with the shield connecting portion, wherein the press-crimping member may comprise a lid portion covering the at least one opening portion.

The press-crimping member may be slidable along the cable in the axial direction.

The press-crimping member may further comprise a positioning portion which is connected to the lid portion, and at least one of the housing and the outer conductor may comprise a positioned portion to be engaged with the positioning portion to position the outer conductor.

The press-crimping member may further comprise a locking portion which is connected to the lid portion, and the outer conductor may comprise a locked portion to be engaged with the locking portion to lock the outer conductor in the axial direction.

The connector may further comprise a conductive shield member which is mounted to the housing and connected to the outer conductor.

The outer conductor may include a pair of flat-plate-like shield parts which extends in parallel with each other between the shield connecting portion and the housing, the shield parts may form a signal connection space which extends in the radial direction, and the terminal portion may be disposed in the signal connection space.

The signal connection space may be connected to the at least one opening portion.

The outer conductor may include a tubular portion between the shield connecting portion and the housing, and the at least one opening portion may be formed on the tubular portion.

The core wire and the terminal portion may be connected to each other by press-crimping.

The core wire and the terminal portion may be connected to each other by soldering.

In the connector according to the exemplary aspect of the present invention, the press-crimping member neither falls off nor rotates upon connection between the cable and the connector. Consequently, the shielding wire is improved in reliability of press-crimping connection.

BEST MODE FOR EMBODYING THE INVENTION

Figure 1:
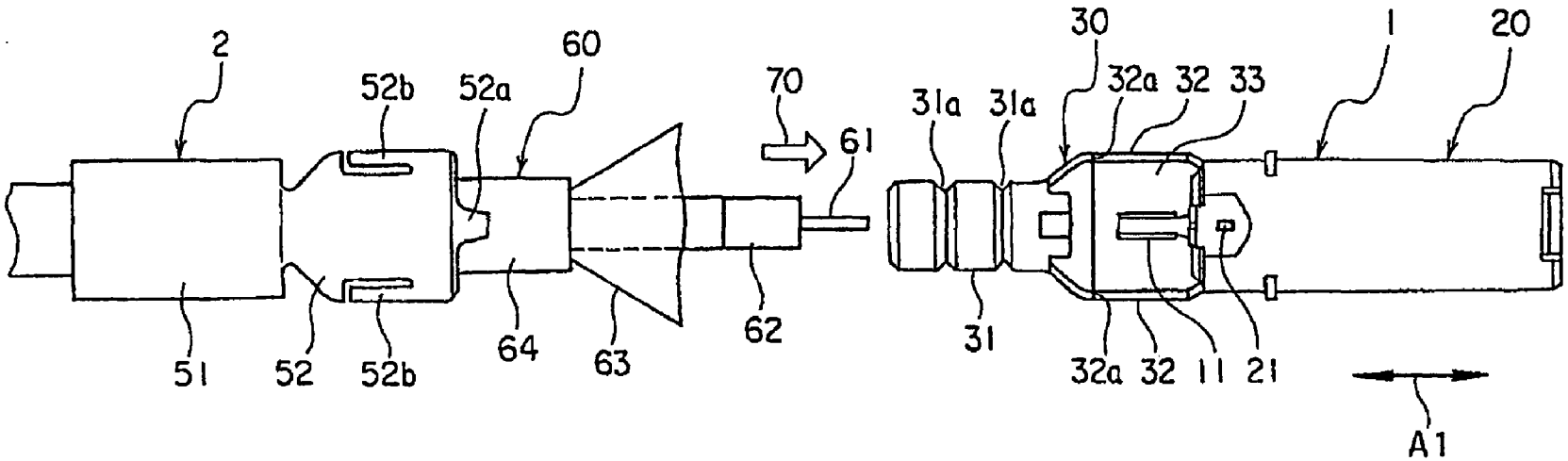
FIG. 1 is a front view of a state before connection, showing a connector according to an exemplary embodiment of the present invention, together with a shielded electric wire to be connected thereto.
Figure 2:
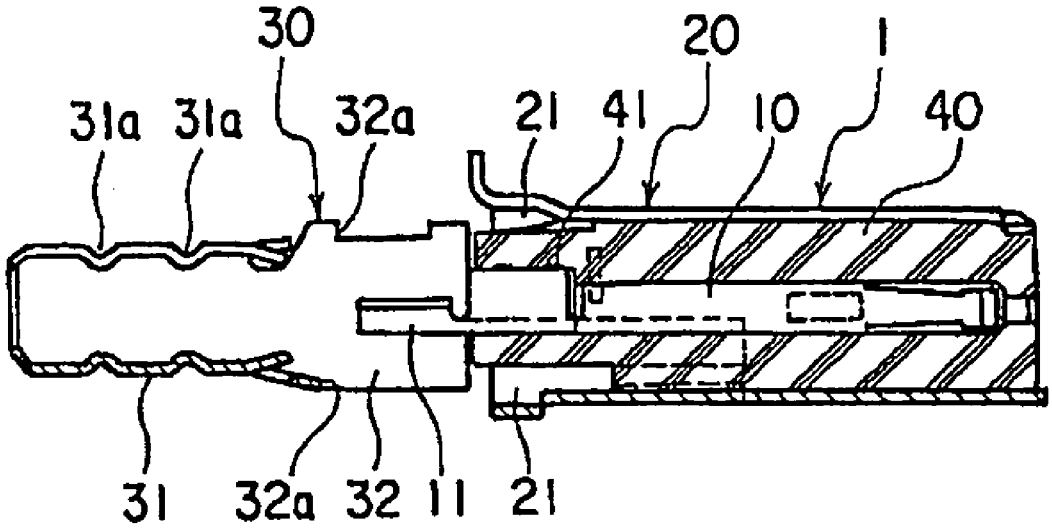
FIG. 2 is a sectional view of a connector main body included in the connector shown in FIG. 1.

Referring to FIGS. 1 and 2, a connector according to an exemplary embodiment of the present invention and a shielded electric wire to be connected thereto will be described.

The connector shown in the figure is a coaxial connector and includes a coaxial unit 1 as a connector main body and a press-crimping member 2 as an auxiliary part for connecting a coaxial cable 60 as the shielded electric wire to the coaxial unit 1. The coaxial unit 1 includes an insulative housing 40, a conductive signal contact 10 held at the center of the housing 40 by a contact holding portion 41, a conductive shielding outer tube 20 surrounding the housing 40, and an outer conductor 30 integrally formed with the shielding outer tube 20. The shielding outer tube 20 has positioned portions 21 in the vicinity of the outer conductor 30.

The outer conductor 30 has a shield connecting portion 31 substantially formed in a cylindrical shape and a pair of flat-plate-like shield parts 32 extending from an axial end of the shield connecting portion 31 toward the shielding outer tube 20 with a space kept from each other. The shield connecting portion 31 has a plurality of ring-shaped concave portions 31*a* extending in a circumferential direction along an outer peripheral surface thereof.

The pair of shield parts 32 spread in a tangential direction substantially in parallel to each other and form a signal connection space 33 extending in a radial direction therebetween. The signal connection space 33 has radial opposite ends connected to the outside. In other words, the outer conductor 30 has two opening portions allowing the signal connection space 33 to communicate with the outside in the radial direction.

Each of the shield parts 32 is connected to the shielding outer tube 20. Each of the shield parts 32 is provided with a locked portion 32*a* formed thereon. The signal contact 10 has a signal connecting portion 11 of a groove shape protruding from the housing 40 to a position between the pair of shield parts 32. It is readily understood that the signal connecting portion 11 is spaced from each of the shield parts 32.

The press-crimping member 2 is formed of a conductive plate and comprises a cylindrical portion 51 fitted and mounted to an outer periphery of the coaxial cable 60 and a pair of lid portions 52 extending from an axial end of the cylindrical portion 51 with a space kept from each other. Each of the lid portions 52 is formed in a generally flat plate shape and has a positioning portion 52*a* and a pair of locking portions 52*b*. As will later become clear, when the coaxial cable 30 is connected to the coaxial connector, the positioning portions 52*a* are positioned by the positioned portions 21 of the shielding outer tube 20 and the locking portions 52*b* are locked by the locked portions 32*a* of the shield parts 32 in an axial direction A1.

The coaxial cable 60 comprises a conductive core wire at the center, namely, a signal wire 61, an insulative interior coating 62 surrounding the signal wire 61, a conductive net-like shielding wire 63 surrounding the interior coating 62, and an insulative exterior coating 64 surrounding the shielding wire 63.

Referring also to FIGS. 3 through 6 in addition to FIG. 1, a connecting operation of the coaxial cable to the coaxial connector will be described.

Prior to connection of the coaxial connector, the coaxial cable 60 is subjected to terminal working as shown in FIG. 1. Specifically, each of the signal wire 61, the interior coating 62, and the shielding wire 63 is exposed by a predetermined length. Next, the press-crimping member 2 is mounted to the outer periphery of the coaxial cable 60. Thereafter, the shielding wire 63 is spread outward in a cone-like shape. In this state, the coaxial cable 60 is moved as shown by an arrow 70 to insert the signal wire 61 and the interior coating 62 into the shield connecting portion 31. Then, an intermediate state of connection shown in FIGS. 3 and 4 is obtained.

Figure 3:
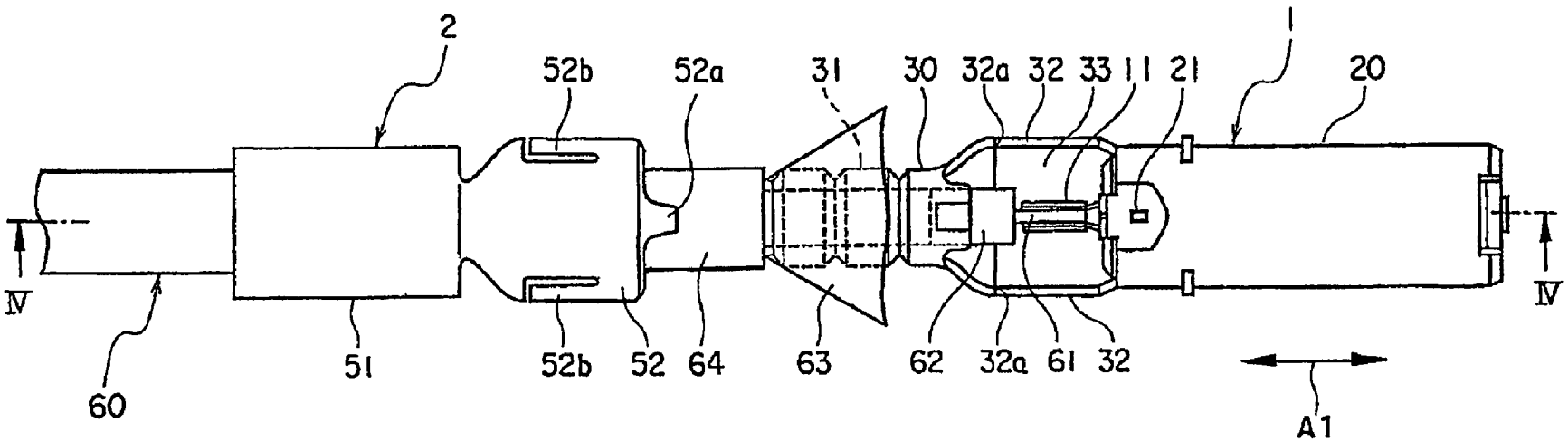
FIG. 3 is a front view of an intermediate state where the connector and the shielded electric wire in FIG. 1 are connected to each other.
Figure 4:
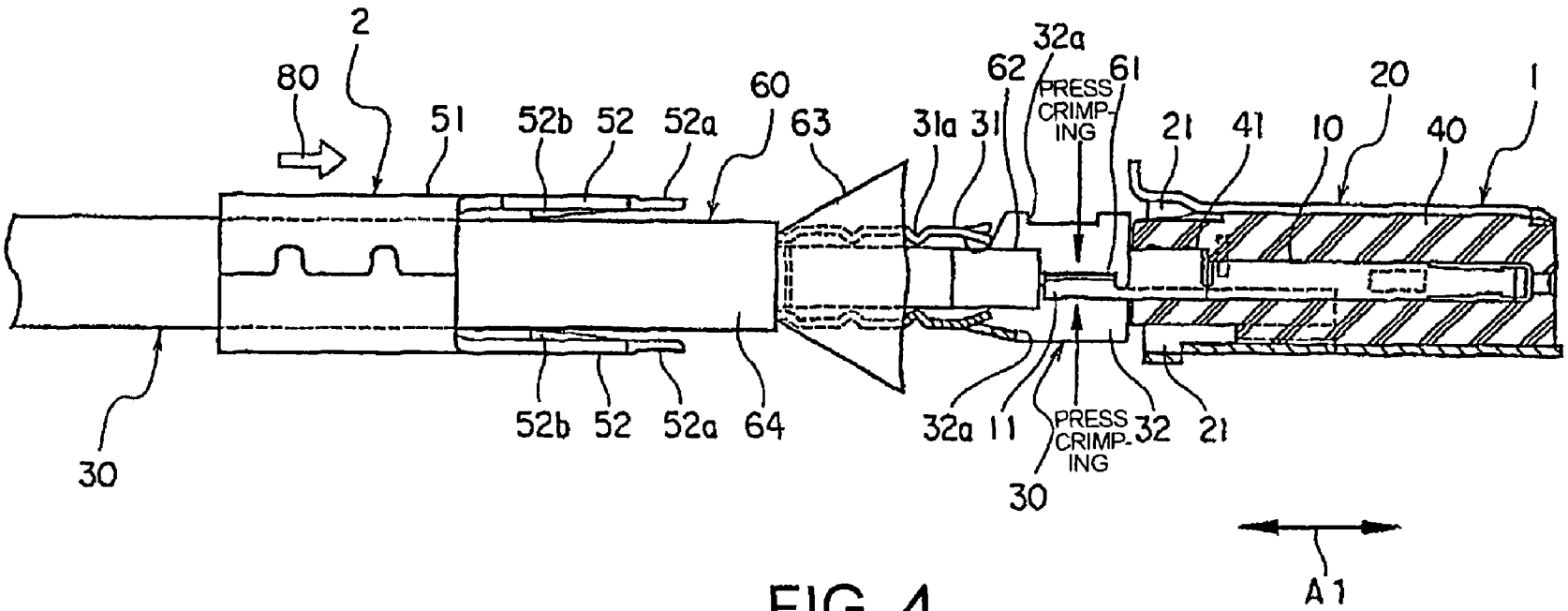
FIG. 4 is a sectional view with only a part shown in section along a line IV-IV in FIG. 3.

In the state shown in FIGS. 3 and 4, the interior coating 62 is disposed inside the shield connecting portion 31 and the signal wire 61 of the coaxial cable 60 is disposed inside the groove shape of the signal connecting portion 11 of the signal contact 10. In this state, a press-crimping jig is inserted into the signal connection space 33 between the pair of shield parts 32 to press-crimp the signal wire 61 to the signal connecting portion 11. As a result, the signal wire 61 of the coaxial cable 60 is electrically and mechanically connected to the signal contact 10. Next, the press-crimping member 2 is slid along the coaxial cable 60 as shown by an arrow 80 to obtain a state shown in FIGS. 5 and 6.

Figure 5:
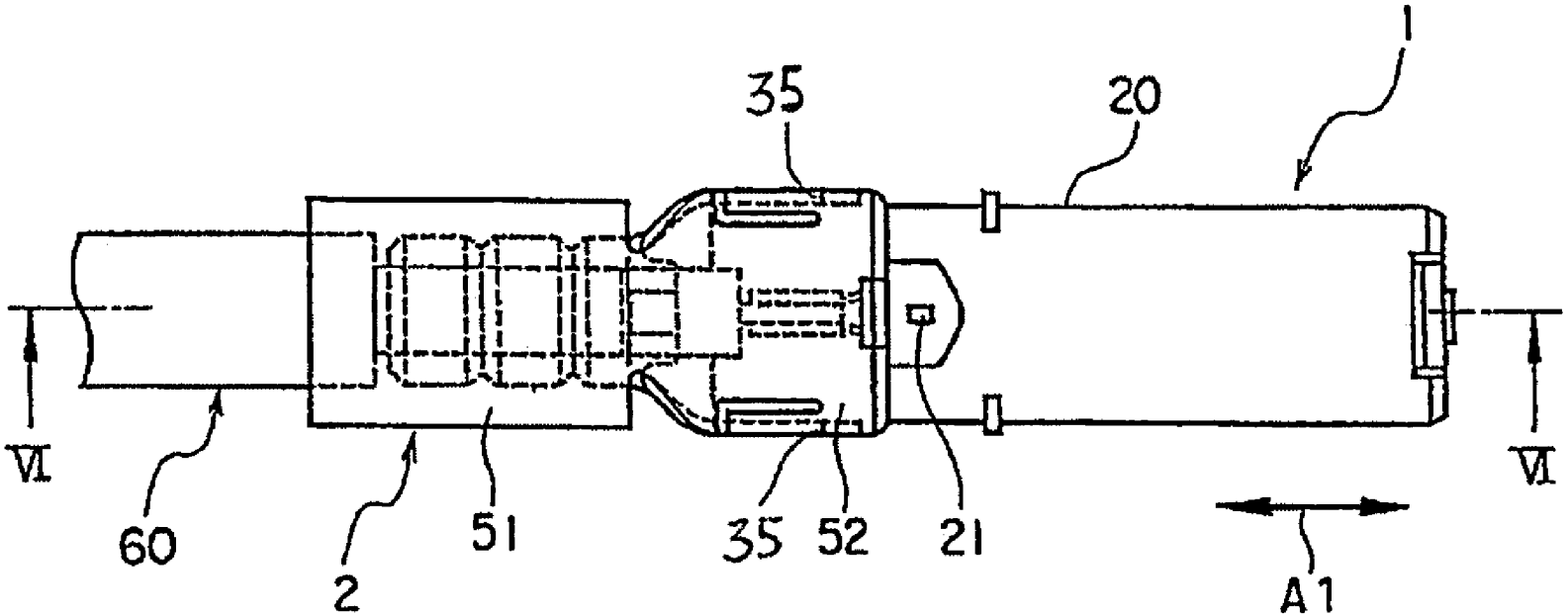
FIG. 5 is a front view of a state after the connector and the shielded electric wire in FIG. 1 are connected to each other.
Figure 6:
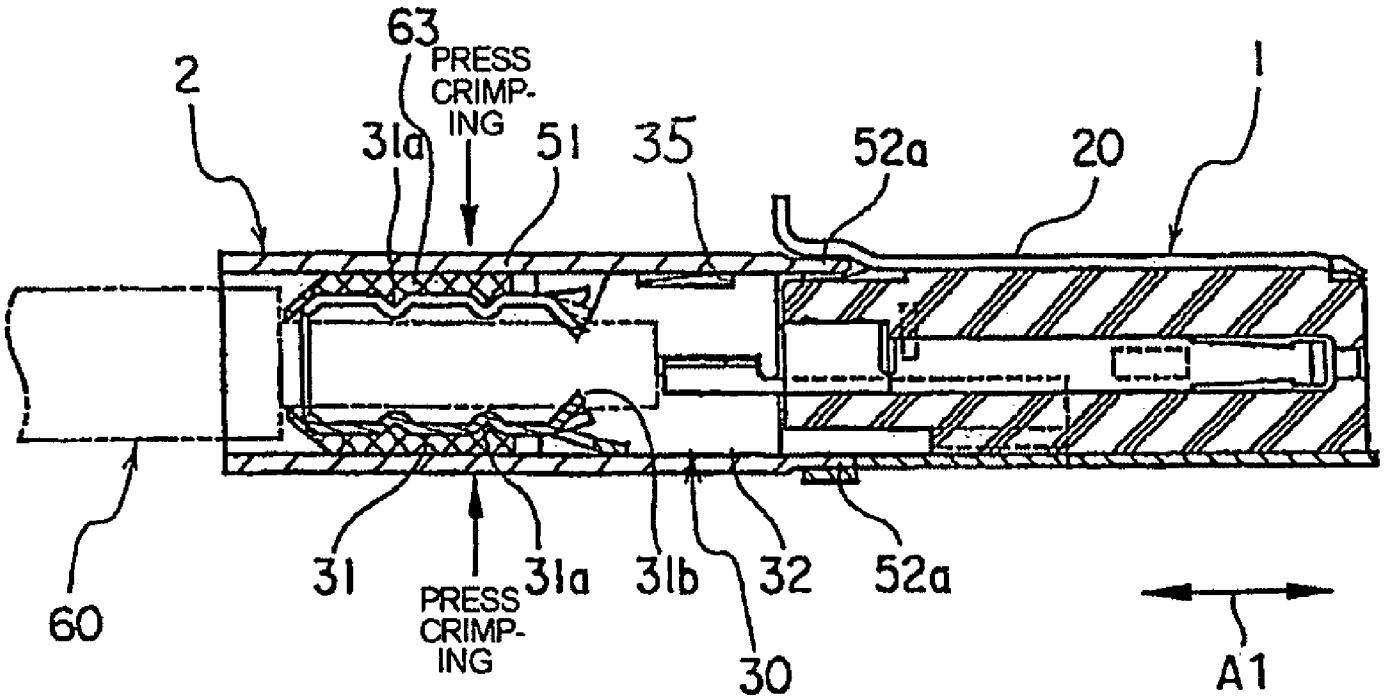
FIG. 6 is a sectional view taken along a line VI-VI in FIG. 5.
Figure 7:
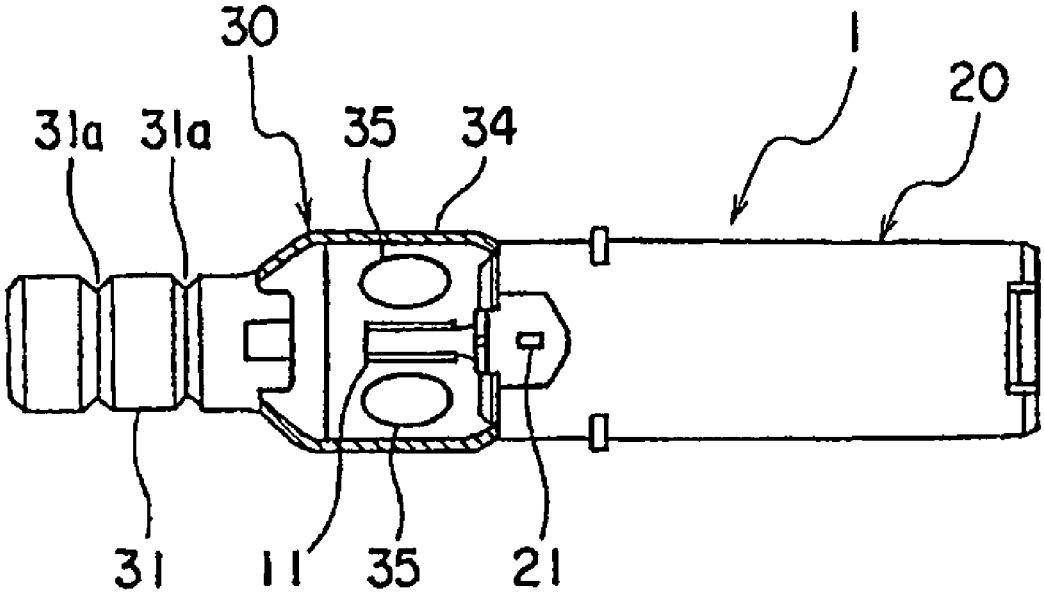
FIG. 7 is a front view of a modified example of the connector main body in FIG. 2, with only a part cutaway.

In the state shown in FIGS. 5 and 6, the cylindrical portion 51 of the press-crimping member 2 press-crimps the shielding wire 63 of the coaxial cable 60 to the connecting portion 31 of the outer conductor 30. In other words, the press-crimping member 2 clamps the shielding wire 63 in cooperation with the connecting portion 31. From opposite sides in the radial direction, the lid portions 52 cover the two opening portions 35 of the outer conductor 30 which allow the signal connection space 33 between the pair of shield parts 32 to communicate with the outside in the radial direction. Thus, in cooperation with each other, the shield parts 32 and the lid portions 52 surround and magnetically shield the connecting portion between the signal connecting portion 11 and the signal wire 61 and its vicinity.

Then, in this state, the locking portions 52*b* of the press-crimping member 2 are engaged with the locked portions 32*a* of the outer conductor 30 in the axial direction A1, respectively. Simultaneously, the positioning portions 52*a* of the press-crimping member 2 are engaged with the positioned portions 21 of the shielding outer tube 20, respectively. Thus, the press-crimping member 2 is reliably connected to the shielding outer tube 20 electrically and mechanically.

Since the locking portions 52*b* and the locked portions 32*a* are engaged with each other, the press-crimping member 2 is held by the outer conductor 30 and is prevented from movement toward a side opposite to a fitting direction in the axial direction A1. In other words, the press-crimping member 2 does not fall off from the outer conductor 3. Further, movement in the fitting direction is prevented by the positioning portions 52*a* and the positioned portions 21. Since the positioning portions 52*a* and the positioned portions 21 are engaged with each other, the lid portions 52 are prevented from moving away from the outer conductor 30 in a direction perpendicular to the axial direction. In other words, the lid portions 52 are prevented from floating. Also, the press-crimping member 2 is prevented from rotating.

Finally, the cylindrical portion 51 of the press-crimping member 2 is pressed from the outside by the same press-crimping jig or another press-crimping jig to bring the shielding wire 63 into press contact with the connecting portion 31. As a result, the shielding wire 63 bites into the ring-shaped concave portions 31*a* of the connecting portion 31. Consequently, the shielding wire 63 and the connecting portion 31 are reliably electrically connected to each other. Thus, reliability of connection and holding strength are excellent. Further, since the connecting portion 31 is provided with claw portions 31*b* which bite into the interior coating 62 of the coaxial cable 60, cable holding strength is improved.

It is readily understood that various modifications are possible. For example, although the connector according to the exemplary embodiment described above is provided with the two pairs of locking portions 52*b* and locked portions 32*a*, only one pair may be provided. Further, instead of the pair of shield parts 32 spaced from each other, the outer conductor 30 may be provided with a tubular portion 34 with opening portions 35 formed on at least two positions of the tubular portion 34 and allowing a press-crimping jig to be inserted therethrough. In that case, the signal wire of the coaxial cable can be press-crimped and connected to the signal connecting portion 11 by the press-crimping jig through the opening portions 35. The signal wire of the coaxial cable and the signal contact may be connected by soldering also. In that case, one opening portion is sufficient. Further, the positioned portions 41 may be formed on the housing 40 or, furthermore, may be formed on both of the housing 40 and the shielding outer tube 20. The present invention can be implemented in a similar manner also as a connector for connecting other kinds of shielded electric wires, not being limited to the coaxial cable.

In the foregoing, the present invention has been described with reference to the embodiment. However, the present invention is not limited to the above-mentioned embodiment. Within the scope of the present invention, the structure and the details of the present invention may be modified in various manners which can be understood by persons skilled in the art.

This application claims priority based on Japanese Patent Application No. 2006-243387 filed on Sep. 7, 2006, the disclosure of which is incorporated herein in its entirety.

The invention claimed is:

1. A connector to be connected to a cable having a core wire and a shielding wire, the connector comprising:

a contact which has a terminal portion to be connected to the core wire;

an outer conductor which has a shield connecting portion to be connected to the shielding wire;

a housing which holds the contact and the outer conductor and integrates the housing, the contact, and the outer conductor to make one body; and a press-crimping member for clamping the shielding wire in cooperation with the shield connecting portion;

wherein the shield connecting portion is separated from the housing in an axial direction;

the outer conductor has two opening portions which are formed between the shield connecting portion and the housing and opened in a radial direction perpendicular to the axial direction;

the terminal portion is exposed inside the outer conductor and faced to one of the opening portions in the radial direction; and the press-crimping member comprises a lid portion covering the opening portions.

2. The connector according to claim 1, wherein the press-crimping member is slidable along the cable in the axial direction.

3. The connector according to claim 1, wherein the press-crimping member further comprises a positioning portion which is connected to the lid portion, and at least one of the housing and the outer conductor comprises a positioned portion to be engaged with the positioning portion of the press-crimping member to position the press-crimping member.

4. The connector according to claim 1, wherein the press-crimping member further comprises a locking portion which is connected to the lid portion, and the outer conductor comprises a locked portion to be engaged with the locking portion to lock the outer conductor in the axial direction.

5. The connector according to claim 1, further comprising a conductive shield member which is mounted to the housing and connected to the outer conductor.

6. The connector according to claim 1, wherein the outer conductor includes a pair of flat-plate-like shield parts which extends in parallel with each other between the shield connecting portion and the housing, the shield parts forms a signal connection space which extends in the radial direction, and the terminal portion is disposed in the signal connection space.

7. The connector according to claim 6, wherein the signal connection space is connected to the opening portions.

8. The connector according to claim 1, wherein the outer conductor includes a tubular portion between the shield connecting portion and the housing, and the opening portions are formed on the tubular portion.

9. The connector according to claim 1, wherein the core wire and the terminal portion are connected to each other by press-crimping.

10. The connector according to claim 1, wherein the core wire and the terminal portion are connected to each other by soldering.

* * * * *